US005083338A

United States Patent [19]

Unger

[11] Patent Number: 5,083,338

[45] Date of Patent: Jan. 28, 1992

[54] CLEANING DEVICE WITH QUICK CONNECT CLEANING ELEMENT

[75] Inventor: Henry M. Unger, Weston, Conn.

[73] Assignee: Unger Licensing Inc., Bridgeport, Conn.

[21] Appl. No.: 554,259

[22] Filed: Jul. 18, 1990

[51] Int. Cl.[5] ..... A47I 1/08

[52] U.S. Cl. ..... 15/121; 15/145; 15/176.2; 15/245; 403/342; 403/118; 279/101

[58] Field of Search ..... 15/121, 145, 176.3, 15/176.2, 176.6, 245; 403/342, 118, 243, 393, 341, 286; 81/177.2, 489; 279/7, 99, 100, 101; 294/2, 24

[56] References Cited

U.S. PATENT DOCUMENTS

| | | | |
|---|---|---|---|
| 797,638 | 8/1905 | Thomas | 403/342 |
| 1,005,834 | 10/1911 | Hibbler | 403/341 |
| 1,557,894 | 10/1925 | Sturgis | 403/342 |
| 2,009,473 | 7/1935 | Britton | 15/145 |
| 2,191,642 | 2/1940 | Carvalho | 15/145 |
| 2,741,788 | 4/1956 | Shey | 15/121 |
| 2,904,806 | 9/1959 | Obergfell | 15/121 |
| 3,516,697 | 6/1970 | Hahn | 403/118 |
| 3,617,078 | 11/1971 | Valukunis | 403/341 |
| 3,682,516 | 8/1972 | Savage | 15/145 |
| 3,789,451 | 2/1974 | Leitner | 15/121 |
| 3,873,747 | 9/1974 | Seymore | 15/121 |
| 4,611,941 | 9/1986 | Karliner et al. | 15/145 |

*Primary Examiner*—Harvey C. Hornsby
*Assistant Examiner*—Gary K. Graham
*Attorney, Agent, or Firm*—Abelman Frayne & Schwab

[57] ABSTRACT

The invention relates to a cleaning apparatus for surfaces, more particularly window panes. It mainly comprises a handle 1 and a two-part holder 4 for rod-shaped or strip-shaped cleaning elements 8 which is releasably attached to the handle 1. The releasable connection comprises: a forwardly open inner sleeve 2 which is formed on the handle 1 and has diametrically opposite axial slots 11, 12; an outer sleeve 3, mounted rotatably but axially non-displaceably on the inner sleeve 2; and a pin 5, 6 which is inserted in the inner sleeve 2 and is divided into two in the axial direction. The outer sleeve 3 has an internal screwthreading 16, 17 recessed by axial grooves 18, 19 at two diametrically opposite places. By the rotation of the outer sleeve 3 in relation to the inner sleeve 2, the grooves 18, 19 can be brought into alignment with the slots 11, 12. In such alignment the pin 5, 6 divided into two, bearing an external screwthreaded portion 20, 21 on each of diametrically opposite sides, can be axially displaced in the inner sleeve 2. By the rotation of the outer sleeve 3 the screwthreaded portions 16, 17 of the outer sleeve 3 are brought into engagement with the screwthreaded portions 20, 21 of the two halves 5, 6 of the pin, the two-part pin 5, 6 being thus fixed in the inner sleeve 2.

19 Claims, 7 Drawing Sheets

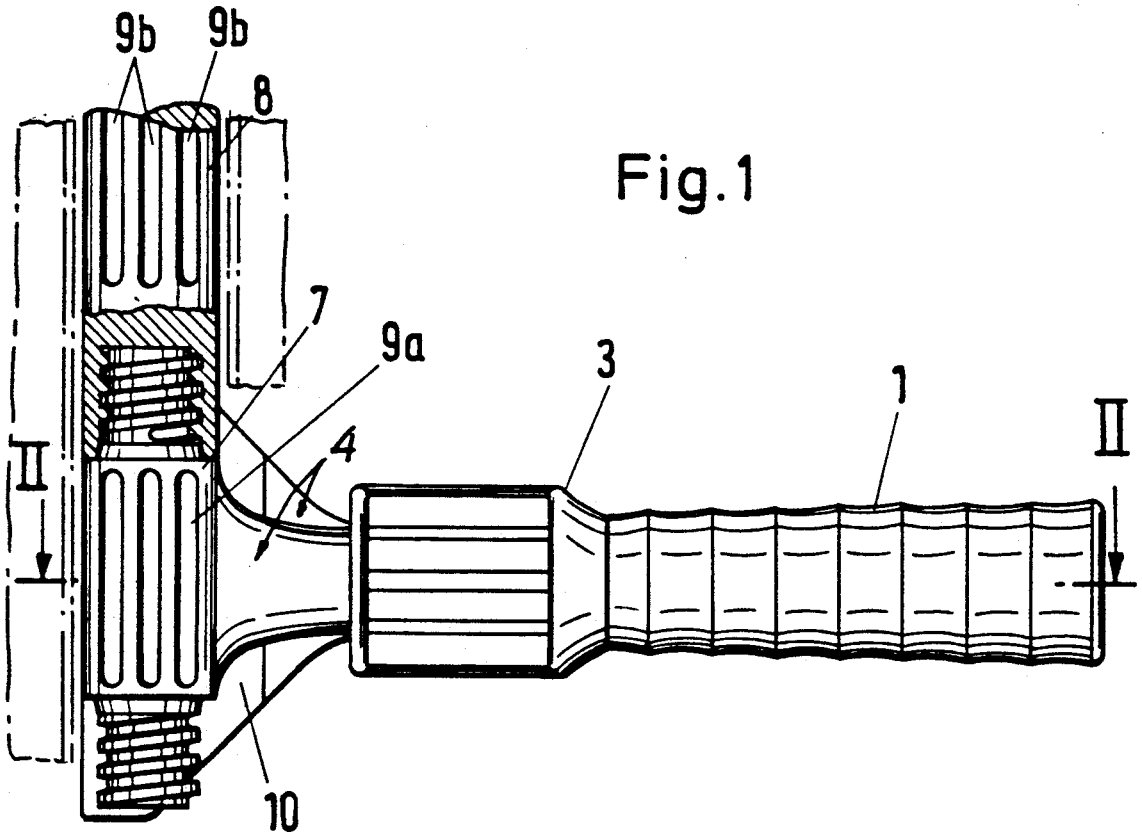
Fig.1
Fig. 2
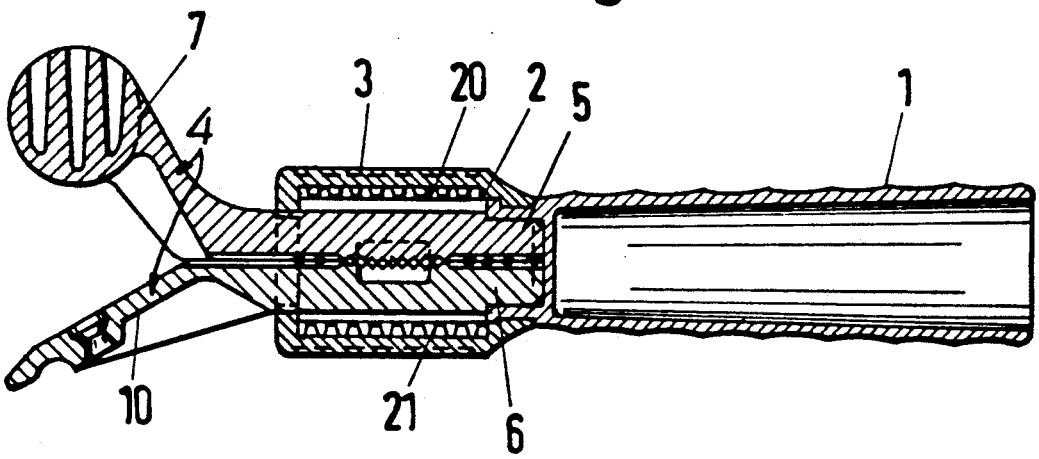

CLEANING DEVICE WITH QUICK CONNECT CLEANING ELEMENT

FIELD OF THE INVENTION

The invention relates to a cleaning apparatus for surfaces, more particularly window panes, comprising a handle and a holder for one or two strip-shaped or rod-shaped cleaning elements releasably attached to the centre of the rod.

BACKGROUND OF THE INVENTION

Cleaning apparatus of the kind specified make use of strip-shaped cleaning elements equipped with wiper blades or of rod-shaped cleaning elements equipped with sponge-like or lambskin-like coverings. The surface to be cleaned is wetted with cleaning fluid by means of the cleaning elements equipped with such coverings, while the strip-shaped cleaning elements equipped with wiper blades wipe the fluid off the surface to be cleaned. If a cleaning apparatus is equipped with these two kinds of cleaning elements, all that the operator needs to do for the two successive jobs is merely to turn the cleaning apparatus through 180°. It is true that such cleaning elements are attached releasably to a handle of varying length, but the attaching means are not adapted to the rapid and frequent interchange of cleaning elements.

SUMMARY OF THE INVENTION

It is an object of the invention to provide a cleaning apparatus of the kind specified wherein the cleaning elements can be interchanged by rapid manual intervention and permanently fixed both against axial movement in the direction of the axis of the holder and also against rotation around such axis. The cleaning apparatus is suitable for being equipped with most various cleaning elements.

To this end according to the invention, in a cleaning apparatus of the kind specified, the handle bears at one end an inner sleeve which has two axial, opposite slots and on which an outer sleeve having an internal screwthreading is mounted rotatably but axially non-displaceably, the internal screwthreading having two opposite recesses in the form of axial grooves which can be brought into a position in alignment with the slots by rotating the outer sleeve; and insertable in the inner sleeve is a pin longitudinally divided axially into two halves, of which at least one pin half bears a holder for a cleaning element, such pin half and the other pin half each bearing an external screwthreading portion which corresponds to the internal screwthreading and whose width so agrees with the width of the slot and the groove that when the slots and the grooves are in alignment, the pin can be axially displaced in the inner sleeve and is axially locked via the intermeshing screwthreadings by the rotation of the outer sleeve.

The cleaning apparatus according to the invention can be equipped with a single cleaning element or with two different cleaning elements. If a single cleaning element is used, the second pin half does not bear a cleaning element. In that case it merely contributes towards fixing the other pin half bearing a cleaning element. The cleaning elements can be released and axially locked in the inner sleeve simply by rotating the outer sleeve by rather less than one half rotation. There is no need for laborious unscrewing, sometimes even using tools. Security against rotation around the axis of the holder is provided by the positive connection of the external screwthreading portions of the two pin halves, which engage in the axial slots of the inner sleeve.

Ease of use is assisted if both the inner and external screwthreading portions have the same shape, in which case the longitudinally divided pin can be inserted in the inner sleeve in both 180° positions and tightened by the rotation of the outer sleeve, since the external and internal screwthreading portions match one another in each of the two positions. Preferably the inner sleeve has a stop for the pin such that when the pin abuts the stop, the external screwthreading portions match the internal screwthreading portions. There is therefore no need for any laborious axial alignment with regard to the matching external and internal screwthreading portions.

For certain jobs using the cleaning apparatus, it may be practical for the two cleaning elements to be offset in relation to one another in the axial direction of the pin. To meet this requirement while at the same time ensuring that the internal and external screwthreading portions mesh with one another in a problem-free manner, according to another feature of the invention the two pin halves are axially secured at their abutting inner sides by a toothing whose pitch is so adapted to the pitch of the screwthreading portions that the screwthreading portions can be intermeshed in every possible axial position of the two pin halves.

According to a possible feature of the invention, to facilitate the insertion of the two pin halves in the inner sleeve, the two pin halves are secured against rotation around a perpendicular axis on the inner sides by an axial tongue-and-groove connection on their abutting inner sides. This tongue-and-groove connection has no adverse effect on the aforedescribed axial offsetting of the two pin halves with the modular dimension of the toothing.

To enable different kinds of cleaning elements to be combined in the cleaning apparatus even with the existing toothing and/or a tongue-and-groove connection, according to another feature of the invention the two inner sides of the pin halves are of identical construction as regards the toothing and/or the tongue-and-groove connection.

DESCRIPTION OF THE DRAWINGS

An embodiment of the invention will now be described in greater detail with reference to the drawings, wherein:

FIG. 1 is a plan view of a cleaning apparatus with handle and two-part holder inserted therein for a strip-shaped cleaning element and a rod-shaped cleaning element.

FIG. 2 is an axial section, taken along the line II—II in FIG. 1 of the cleaning apparatus shown in FIG. 1.

DESCRIPTION OF THE PREFERRED EMBODIMENTS

Figure 3:
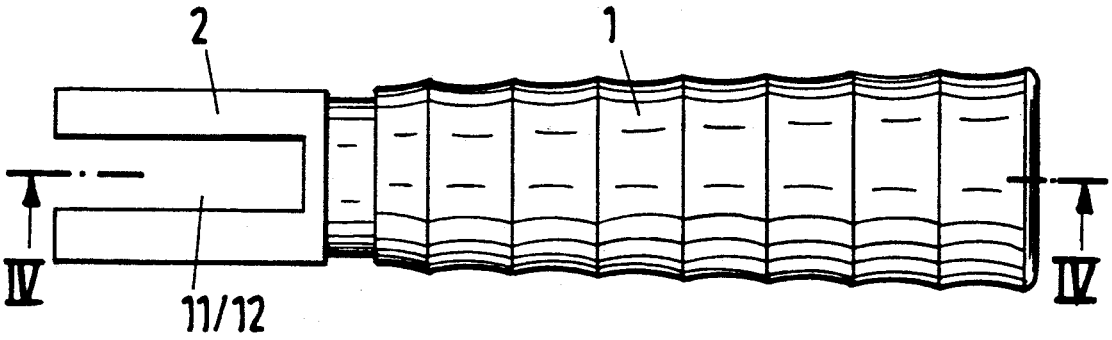
FIG. 3 is an elevation of a structural component of the cleaning apparatus shown in FIG. 1, namely a handle with a formed-on inner sleeve.

In the embodiment illustrated a cleaning apparatus has a hollow cylindrical handle 1 into which an extension rod can be inserted; a hollow cylindrical inner sleeve 2 formed on the handle 1; an outer sleeve 3 which is mounted rotatably, but axially non-displaceably on the inner sleeve 2; and a two-part holder 4 inserted in the inner sleeve 2 via a pin 5, 6 axially divided into two.

One holding part 7 of the two-part holder 4 is adapted for the screwing-on of two rod-shaped arms 8 which can be given a hose-like covering of a lambskin-like or other aborptive material as indicated by the chain dotted lines 8*a*. To increase the absorption of liquid, the holding part 7 and the arms 8 are formed with chambers 9*a*, 9*b*.

The other holding part 10 of the holder 4 is adapted for the screwing-on of a strip-like wiper blade.

Figure 4:
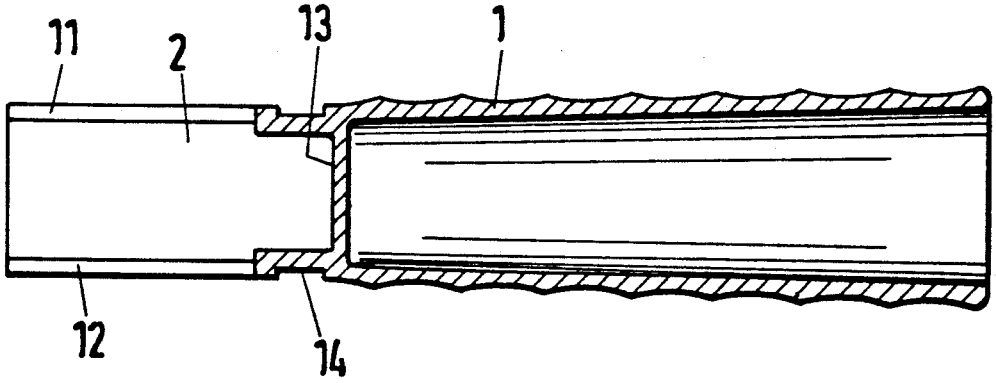
FIG. 4 shows in axial section, taken along the line IV—IV in FIG. 3, the handle with inner sleeve shown in FIG. 3.
Figure 5:
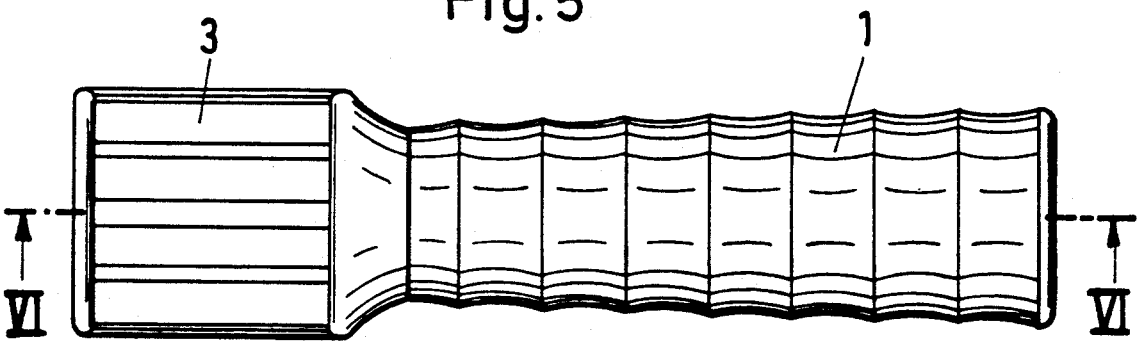
FIG. 5 is an elevation of the handle shown in FIG. 3 with an outer sleeve disposed on the inner sleeve.
Figure 6:
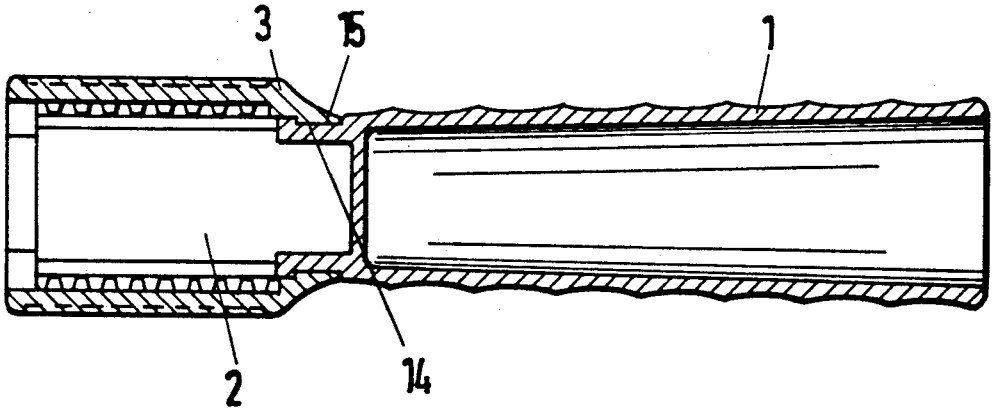
FIG. 6 is an axial section, taken along the line VI—VI in FIG. 5, of the handle with inner sleeve and outer sleeve shown in FIG. 5.
Figure 15:
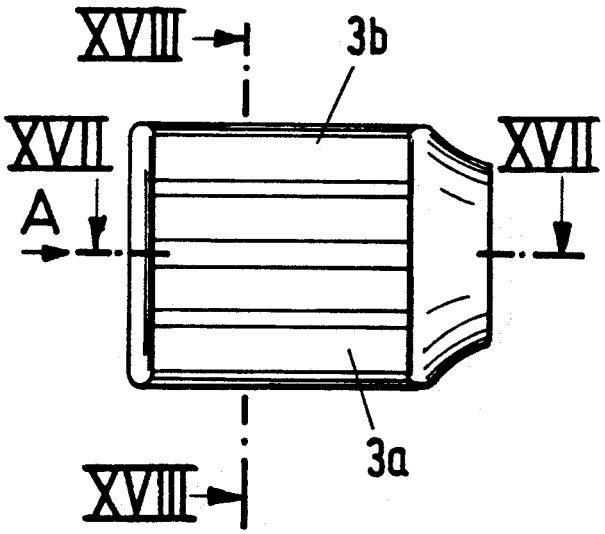
FIG. 15 is an elevation of an outer sleeve.
Figure 16:
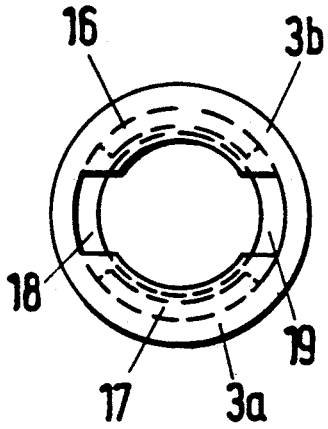
FIG. 16 shows the outer sleeve illustrated in FIG. 15 in the end elevation A therein.
Figure 17:
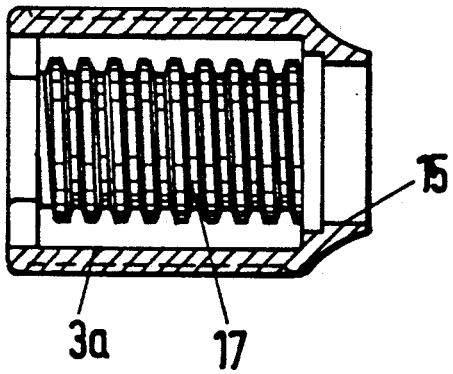
FIG. 17 is an axial section, taken along the line XVII—XVII in FIG. 15, through the outer sleeve shown in FIG. 15.
Figure 18:
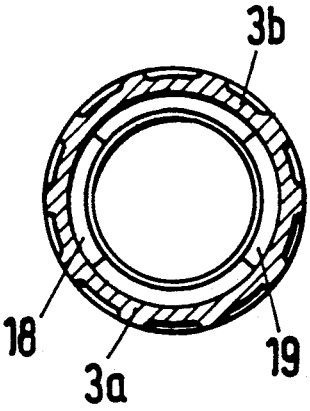
FIG. 18 is a cross-section, taken along the line XVI—XVI in FIG. 15, through the outer sleeve shown in FIG. 15.

As shown more particularly in FIGS. 3 and 4, the inner sleeve 2 is formed with two diametrically opposite slots 11, 12 which are open in the direction of the end face. On its side opposite the open end face the inner sleeve 2 is dish-shaped, the bottom 13 of the end face of the two part pin 5, 6 acting as a stop. An annular groove 14 is provide the outside of the wall of the dished part. The outer sleeve 3, shown as an individual component in FIGS. 15–17, with a correspondingly shaped collar 15 is guided in the annular groove 14, as shown in FIGS. 2 and 6.

For assembly purposes, the outer sleeve 3 is made up of two half shells 3*a*, 3*b* which are welded together at their joint after positioning on the inner sleeve 2.

The outer sleeve 3 has two absolutely identically constructed internal screwthreading portions 16, 17 between which diametrically opposite axial grooves 18, 19 extend as far as the end face of the outer sleeve 3. The width of the axial grooves 18, 19 is equal to the width of the axial slots 11, 12 of the inner sleeve 2. The grooves 18, 19 can therefore be brought into alignment with the slots 11, 12 by rotating the outer sleeve 3 on the inner sleeve 2.

The two pin halves 5, 6 of the two holding parts 7, 10 are absolutely identically shaped. Their external periphery bears a portion 20, 21 of an external screwthreading which corresponds to the two portions 16, 17 of the internal screwthreading of the outer sleeve 3. The width of the screwthreading portions 20, 21 in the peripheral direction is equal to the width of the axial slots 11, 12 and the grooves 18, 19. When the slots 11, 12 and the grooves 18, 19 are aligned, the two-part pin 5, 6 can be inserted until the end face of the two-part pin 5, 6 bears against the end 13, as shown in FIG. 2. By the subsequent rotation of the outer sleeve 3, its internal screwthreading portions 16, 17 are brought into engagement with the external screwthreading portions 20, 21 of the two-part pin 5, 6, which is thus axially fixed in the inner sleeve 2. The screwthreading portions 16, 17, 20, 21 are so shaped that less than half a rotation is required for fixation. Due to the absolutely identical construction of the two screwthreading portions 16, 17 and 20, 21 the two-part pin 5, 6 can be inserted in both positions of rotation through 180° and fixed by screwing. The position of the screwthreading portions 20, 21 in relation to the end face stop at the end 13 is so designed that in the stop position the screwthreadings can mesh with one another, and no subsequent axial adjustment is required. The external screwthreading portions 20, 21 engaging in the axial slots 11, 12 secure the two-part pin 5, 6 against rotation around the axis of the pin 5, 6 in the inner sleeve 2.

Figure 7:
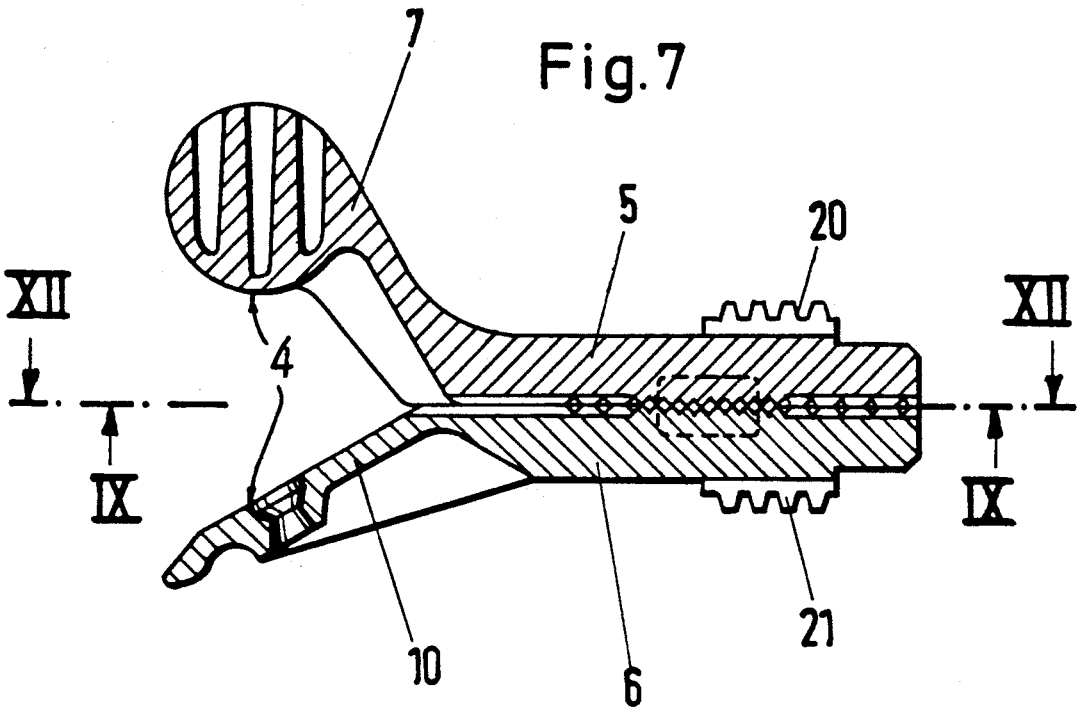
FIG. 7 is an axial section, taken along the line II—II in FIG. 1, of the two-part holder for the cleaning elements.
Figure 8:
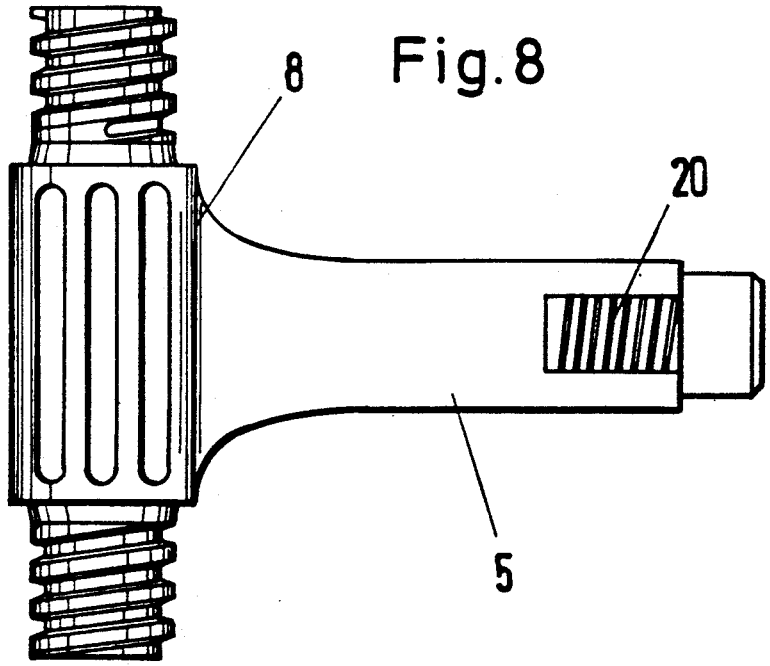
FIG. 8 is a plan view of that part of the two-part holder shown in FIG. 7 which is equipped with rod-shaped cleaning elements.
Figure 9:
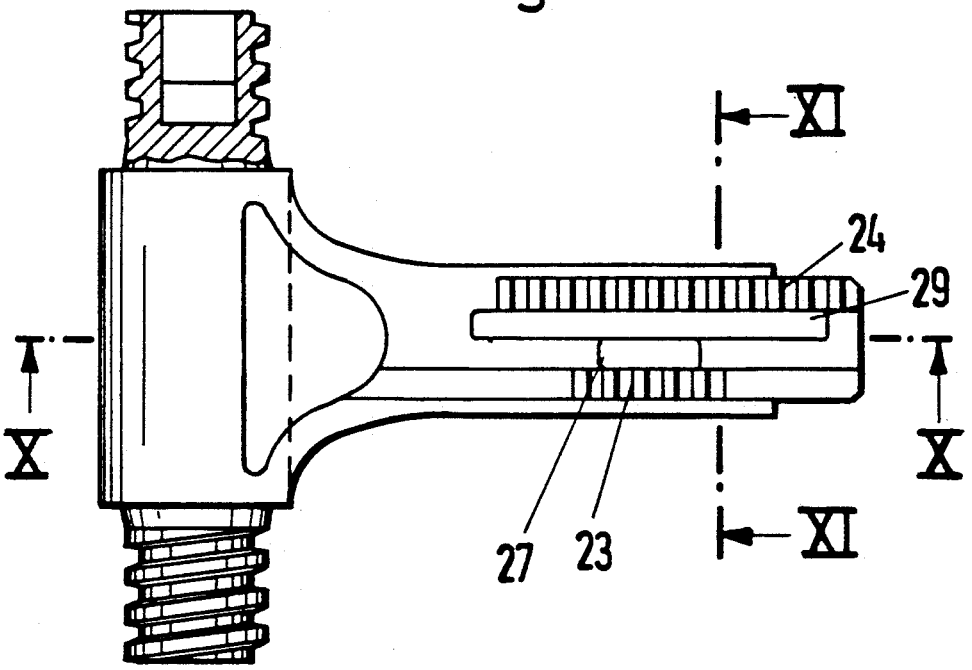
FIG. 9 is a plan view, taken along the sectional line IX—IX in FIG. 7, of the holding part for the rod-shaped cleaning elements.
Figure 10:
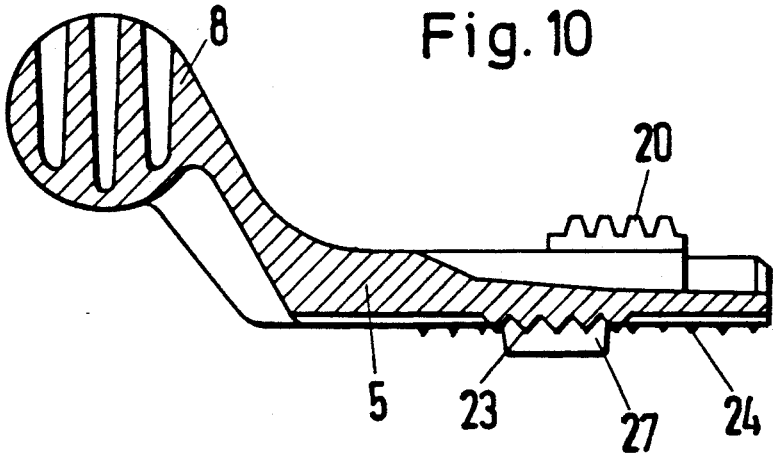
FIG. 10 is an axial section, taken along the line X—X in FIG. 9, of the holding part for the rod-shaped cleaning elements.
Figure 11:
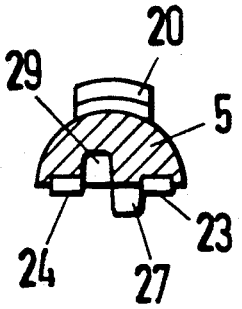
FIG. 11 is a cross-section, taken along the line XI—XI in FIG. 9, through a pin half of the holding part for the rod-shaped cleaning elements.
Figure 12:
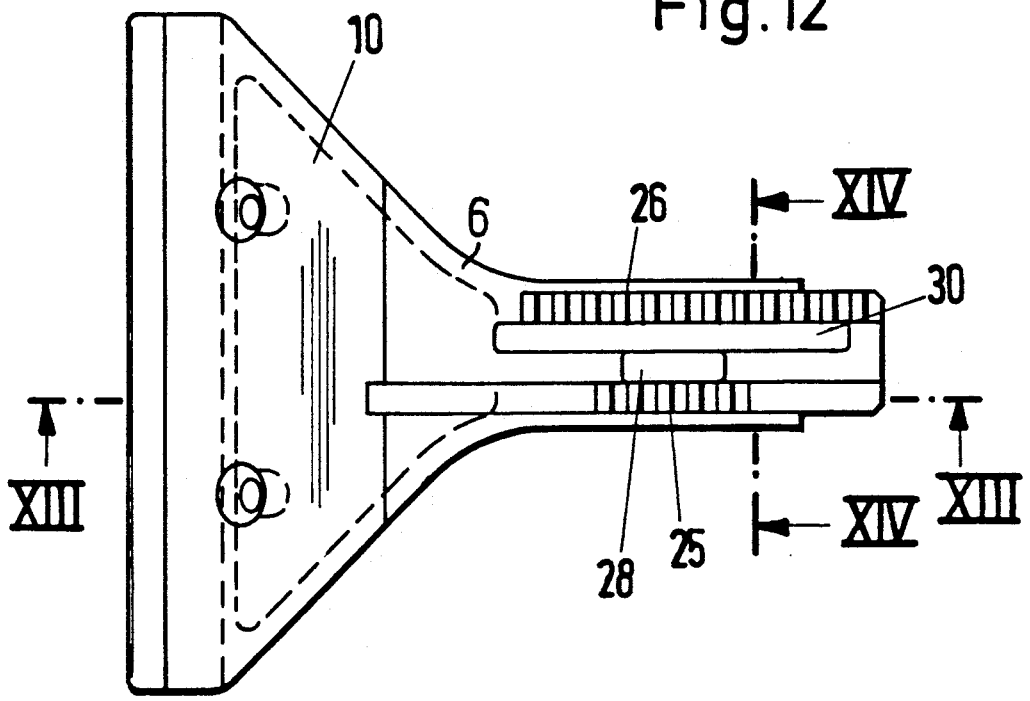
FIG. 12 is a plan view, taken along the line XII—XII in FIG. 7, of a holding part adapted for equipment with strip-shaped cleaning elements.
Figure 13:
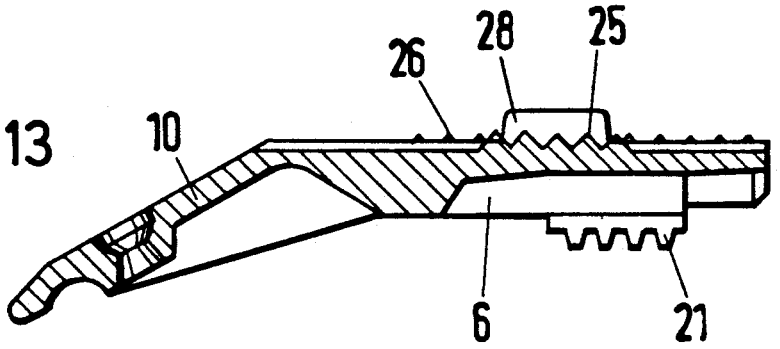
FIG. 13 is an axial section, taken along the line XIII—XIII in FIG. 12, through the holding part for the strip-shaped cleaning elements.
Figure 14:
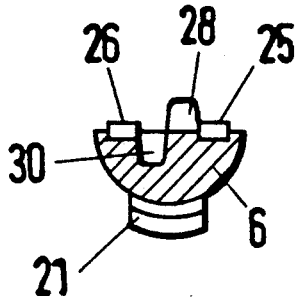
FIG. 14 is a cross-section, taken along the line XIV—XIV in FIG. 12, through a pin half of the holding part shown in FIG. 12.

As shown in FIG. 7, but even more clearly in FIGS. 8 to 14, the superjacent inner sides of the two pin halves 5, 6 bear two axial rows of teeth 23, 24, 25, 26 and therebetween a spring 27, 28 and a groove 29, 30. The arrangement of these elements is absolutely identical in the case of both pin halves 5, 6, the modular dimension of the toothing of the rows of teeth 23, 24, 25, 26 being so adapted to the screwthreading portions 20, 21 that the screwthreading portions 20, 21 of the pin halves 5, 6 are aligned with the internal screwthreading portions 16, 17 of the outer sleeve 3 in every axially offset position of the two pin halves 5, 6 with the end face of a pin half 5 or 6 abutting the end 13. The intermeshing tongue-and-groove connections 27, 30 and 28, 29 enable the two pin halves 5, 6 to move axially in relation to one another, but prevent any axial offsetting around an axis perpendicular to the pin axis.

I claim:

1. In a cleaning device of the type having a handle, and a cleaning element detachably attachable to said handle, further including a locking device for securing said cleaning element to said handle, said locking device comprising:

a tubular portion at one end of said handle, said tubular portion having at least one open ended slot extending longitudinally of an outer wall of the tubular portion;

an outer sleeve rotatable on said tubular portion and held captive against axial displacement relative thereto;

said outer sleeve being formed internally with a screw thread, and having at least one internal axially directed slot intersecting said internal screw thread and registerable with said axially extending slot in said tubular portion upon rotation of said outer sleeve relative to said tubular portion;

whereby, with said respective slots aligned one with the other, upon the insertion of a shank of a said cleaning element into said tubular portion, a key extending longitudinally of said shank is received within said aligned grooves, said key having a radially outer surface of thread form corresponding with the internal thread of said outer sleeve, said shank being lockable within said tubular portion upon rotation of said outer sleeve relative to said tubular portion of an angular extent sufficient to move said aligned slots out of alignment with one another.

2. The cleaning device of claim 1, in which said tubular portion and said outer sleeve each have dual said slots extending on opposite sides of a plane passing through the longitudinal axis of said tubular portion and outer sleeve, said shank having dual said keys for reception respectively in said respective slots.

3. The cleaning device of claim 2, in which said slots in said tubular portion and said outer sleeve are located diametrically opposite each other.

4. The cleaning device of claim 1, in which said tubular portion and said outer sleeve each have dual said slots extending on opposite sides of a plane passing through the longitudinal axis of said tubular portion and outer sleeve, whereby dual axially extending shank portions each having a said key and which in combination comprise said shank are simultaneously lockable within said tubular portion upon rotation of said outer sleeve relative to said tubular portion.

5. The cleaning device of claim 4, in which said slots in said tubular portion and said outer sleeve are arranged diametrically opposite each other.

6. A cleaning device of the type having a handle, and a cleaning element detachably attachable to said handle, said cleaning device comprising:

a tubular portion at one end of said handle, said tubular portion having at least one open ended slot extending longitudinally of said tubular portion;

an outer sleeve rotatable on said tubular portion and held captive against axial displacement relative thereto;

said outer sleeve being formed internally with a screw thread and having at least one internal axially extending slot intersecting said internal screw thread and which is registerable with said axially extending slot in said tubular portion upon rotation of said outer sleeve relative to said tubular portion; and, a cleaning element having a shank receivable within said tubular portion, said shank having an axially extending key receivable within said slots when said slots are axially aligned one with the other, said key having a radially outer surface of thread form corresponding with said internal thread of said outer sleeve, said shank being lockable within said tubular portion upon rotation of said outer sleeve relative to said tubular portion.

7. The cleaning device of claim 6, in which said tubular portion and said outer sleeve each have dual said slots extending on opposite sides of a plane passing through the longitudinal axis of said tubular portion and outer sleeve, and said shank has dual said keys for reception in said respective slots.

8. The cleaning device of claim 7, in which said slots in said tubular portion and said outer sleeve are arranged diametrically opposite each other.

9. The cleaning device of claim 6, in which said tubular portion and said outer sleeve each have dual said slots extending on opposite sides of a plane passing through the longitudinal axis of said tubular portion and outer sleeve, said shank being comprised by dual axially extending shank portions that in combination comprise said shank, each said shank portion being provided with a said key, whereby shank portions are simultaneously lockable within said tubular portion upon rotation of said outer sleeve relative to said tubular portion.

10. The cleaning device of claim 9, in which said slots in said tubular portion and said outer sleeve are arranged diametrically opposite each other.

11. The cleaning device of claim 9, in which said cleaning element comprises dual cleaning tools each having a shank portion which in combination constitute said shank, and a said key of thread form at a radially outer surface thereof extends longitudinally of each said shank portion.

12. The cleaning device of claim 9, in which said shank portions each comprise one half of said shank, said shank portions including mutually interfitting serrated surfaces on the mutually presented faces of each said shank portion of a pitch corresponding to the pitch of said thread, thus permitting securement of said shank portions to each other in any one of a number of positions of longitudinal adjustment relative to each other.

13. The cleaning element of claim 12, further including interfitting key and key way means extending longitudinally of said mutually presented faces of said shank portions for guiding said shank portions for longitudinal movement relative to each other.

14. In a cleaning device of the type having a handle, and a cleaning element detachably attachable to said handle, a cleaning element comprising:

a cleaning tool having a shank;

at least one key extending longitudinally of said shank, said key being of thread form at a radially outer surface thereof;

said shank being receivable within a tubular portion of said handle with said key extending through an axial slot in said handle, and being lockable within said tubular portion by an internally threaded sleeve rotatable on said tubular portion and held captive against axial displacement relative to said tubular portion.

15. The cleaning device of claim 14, in which said cleaning element comprises dual cleaning tools each having a shank portion which in combination constitute said shank, further including a said key of thread form at a radially outer surface thereof extending longitudinally of each said shank portion, said shank portions being receivable within a tubular portion of said handle with said respective keys extending through respective axial slots in said handle, said shank portions being lockable within said tubular portion by an internally threaded sleeve rotatable on said tubular portion and held captive against displacement relative thereto.

16. The cleaning device of claim 15, in which said shank portions each comprise one half of said shank, said shank portions each including mutually interfitting serrated surfaces on the mutually presented faces of said shank portions of a pitch corresponding to the pitch of said thread, thus permitting securement of said shank portions to each other in any one of a number of positions of longitudinal adjustment relative to each other.

17. The cleaning device of claim 16, further including interfitting key and key way means extending longitudinally of the mutually presented faces of said shank portions for guiding said shank portions for longitudinal movement relative to each other prior to interengagement of said interfitting serrated surfaces on said respective shank portions.

18. In a cleaning device of the type having a handle, and a cleaning element detachably attachable to said handle, further including a locking device for securing said cleaning element to said handle, said locking device comprising:

a tubular portion at one end of said handle, said tubular portion having at least one open ended slot extending longitudinally of an outer wall of the tubular portion;

an outer sleeve rotatable on said tubular portion and held captive against axial displacement relative thereto;

said outer sleeve being formed internally with axially spaced, circumferentially extending teeth, and having at least one internal axially directed slot intersecting said internal teeth and registerable with said axially extending slot in said tubular portion upon rotation of said outer sleeve relative to said tubular portion;

whereby, with said respective slots aligned one with the other, upon the insertion of a shank of a said cleaning element into said tubular portion, a key extending longitudinally of said shank is received within said aligned grooves, said key having a radially outer surface having axially spaced teeth complimentary to the internal teeth of said outer sleeve, said shank being lockable within said tubular portion upon rotation of said outer sleeve relative to said tubular portion of an angular extent sufficient to move said aligned slots out of alignment with one another.

19. The cleaning device of claim 18, in which said teeth are inclined relative to a plane extending perpendicular to the longitudinal axis of said outer sleeve, said teeth each comprising a segment of a helix, and said teeth of said key are complimentarily inclined to said plane.

* * * * *

UNITED STATES PATENT AND TRADEMARK OFFICE

CERTIFICATE OF CORRECTION

PATENT NO. : 5,083,338

DATED : January 28, 1992

INVENTOR(S) : HENRY M. UNGER

It is certified that error appears in the above-identified patent and that said Letters Patent is hereby corrected as shown below:

On the title page, after item [22], please insert the following:

"(30) Foreign Application Priority Date

Aug 30 1989 W. Germany P 3928668.1-15".

Signed and Sealed this

Sixth Day of July, 1993

Attest:

Michael K. Kirk

MICHAEL K. KIRK

Attesting Officer

Acting Commissioner of Patents and Trademarks